US007533796B1

(12) United States Patent
Catropa

(10) Patent No.: US 7,533,796 B1
(45) Date of Patent: May 19, 2009

(54) MAILBOX HAVING FOUR-WAY ACCESS

(76) Inventor: Ernie Catropa, 1087 Bronson Rd., Fairfield, CT (US) 06824

( * ) Notice: Subject to any disclaimer, the term of this patent is extended or adjusted under 35 U.S.C. 154(b) by 0 days.

(21) Appl. No.: 12/056,889

(22) Filed: Mar. 27, 2008

(51) Int. Cl.
*B65G 11/04* (2006.01)

(52) U.S. Cl. ..... 232/45; 232/17

(58) Field of Classification Search ..... 232/45, 232/17, 38, 29, 33, 19, 28; 220/822, 826; 49/163, 168, 402
See application file for complete search history.

(56) References Cited

U.S. PATENT DOCUMENTS

| | | | | | |
|---|---|---|---|---|---|
| 672,518 | A * | 4/1901 | Wright | ..... | 232/17 |
| 676,913 | A * | 6/1901 | Randall | ..... | 232/25 |
| 736,815 | A * | 8/1903 | Brown | ..... | 232/17 |
| 1,204,494 | A * | 11/1916 | Sare | ..... | 232/45 |
| 2,561,007 | A * | 7/1951 | Bierig | ..... | 232/17 |
| 3,946,939 | A | 3/1976 | Schifman | | |
| 4,650,113 | A * | 3/1987 | Hunt | ..... | 232/17 |
| 5,460,325 | A * | 10/1995 | Surman | ..... | 232/17 |
| 7,044,360 | B2 * | 5/2006 | Campbell | ..... | 232/17 |
| 7,111,772 | B2 | 9/2006 | MacNeill | | |

* cited by examiner

*Primary Examiner*—William L. Miller
(74) *Attorney, Agent, or Firm*—Jay M. Schloff; Intellipex PLLC

(57) ABSTRACT

Disclosed is a mailbox for placing and retrieving mail. The mailbox includes a lower member, an upper member and a front member. The lower member includes a base, a pair of lateral sidewalls and a rear wall configured to obtain a box shaped enclosure with a top opening and a front opening. The upper member is pivotally coupled to the base that encloses the pair of lateral sidewalls and the rear wall of the lower member. The upper member comprises an opening capable of being aligned to the front opening. The front member is pivotally coupled to the base to close the opening of the upper member thereby closing the front opening of the lower member.

7 Claims, 2 Drawing Sheets

MAILBOX HAVING FOUR-WAY ACCESS

FIELD OF THE INVENTION

The present invention relates to mailboxes, and more particularly to mailboxes used in rural areas and mounted on posts for placing and retrieving mail.

BACKGROUND OF THE INVENTION

In rural areas, a mailbox is generally mounted with the help of a mounting plate on a post at a roadside for placing mail therein, and for retrieving mail therefrom. Such mailbox usually has an oblong structure with a front opening, which is closeable. The front opening of the mailbox facilitates use of the mailbox, such as by a person placing the mail within the mailbox and a postman retrieving the mail from the mailbox. In most cases, the front opening of the mailbox is positioned in a manner such that it faces the roadside. Due to such positioning, while depositing and retrieving mail, the user may be have enter the roadside, thereby exposing his/her body to traffic running on the road. This position may be quite dangerous as any running vehicle may hit the user on the roadside while he or she is using the mailbox. Furthermore, although the front opening allows a user to place and retrieve mail while sitting in a vehicle, the size of the front opening may be insufficient to permit easy placement and retrieval of the mail by the user.

Accordingly, there is a need of a mailbox that should protect the user from running traffic as well as maintaining the provision of the front opening to enable the user to place and retrieve mail while sitting in the vehicle on the roadside. Further, the mailbox should also provide options to the user to place and retrieve the mails without in a standing position (i.e. without having to bend over.) Furthermore, there is a need of a mailbox that may be mounted on the post without requiring a mounting plate.

SUMMARY OF THE INVENTION

An object of the present invention is to provide a mailbox that is capable of providing safety to a user from running traffic while the user is placing or retrieving mail from the mailbox, by allowing the user to place or retrieve mail by standing along a side of the mailbox that does not lie on a roadside.

Another object of the present invention is to provide a mailbox that has a provision of a front opening to place and retrieve mail from a front side of the mailbox, which lies on a roadside, while a user sitting in a vehicle on the roadside.

Another object of the present invention is to provide a mailbox that is capable of facilitating a user for placing and retrieving the mail without bending over his/her body.

Another object of the present invention is to provide a mailbox that is capable of being mounted on a post without a mounting plate.

In view of the foregoing disadvantages inherent in the prior art, the general purpose of the present invention is to provide a mailbox configured to include all advantages of the prior art, and to overcome the drawbacks inherent therein.

In an aspect, the present invention provides a mailbox, preferably, to be used in rural areas, for placing and retrieving mail. The mailbox comprises a lower member, an upper member and a front member. The lower member comprises a base, a pair of lateral sidewalls and a rear wall. The base has a flat structure comprising a rear side portion, a front side portion and a pair of lateral side portions. The pair of lateral sidewalls, which are placed opposite to each other, extends upwardly from the pair of lateral side portions of the base, and the rear wall extends upwardly from the rear side portion of the base. The base, the pair of lateral sidewalls and the rear wall are configured to obtain a box shaped enclosure with a top opening and a front opening. The upper member is pivotally coupled to the lateral sidewalls adjacent the front side portion of the base. The upper member is configured to at least partially enclose the pair of lateral sidewalls and the rear wall of the lower member. The upper member comprises an opening that is capable of being aligned to the front opening of the lower member. The front member is pivotally coupled to the lateral sidewalls adjacent the front side portion of the base and is configured to close the opening of the upper member, thereby closing the front opening of the lower member.

The mailbox obtained from the aforesaid arrangement is capable of comfortably placing the mail in the mailbox and retrieving the mail from the mailbox, when a user is standing at a front side, a rear side or two lateral sides of the mailbox.

These together with the aspect of the present invention, along with the various feature of novelty that characterize the present invention, are pointed out with particularity in the claims annexed hereto and form a part of the present invention. For a better understanding of the present invention, its operating advantages, and the specified object attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting.

The terms "top", "lower", "upper", "rear", "front" and the like, herein do not denote any order, elevation or importance, but rather are used to distinguish placement of one element over another, and the terms "a" and "an" herein do not denote a limitation of quantity, but rather denote the presence of at least one of the referenced item.

The present invention provides a mailbox preferably to be used in rural areas. The mailbox may be mounted on a post on a roadside. The mailbox comprises a plurality of openings, which are closeable by a plurality of members coupled by a pivot pin. The plurality of openings facilitates a user to place mail in the mailbox, or retrieve the mail from the mailbox without bending his/her body over, and simultaneously protecting his/her body from traffic running along the roadside. Moreover, the plurality of openings in the mailbox also facilitates the user to place and retrieve the mails while sitting in a vehicle.

Figure 1:
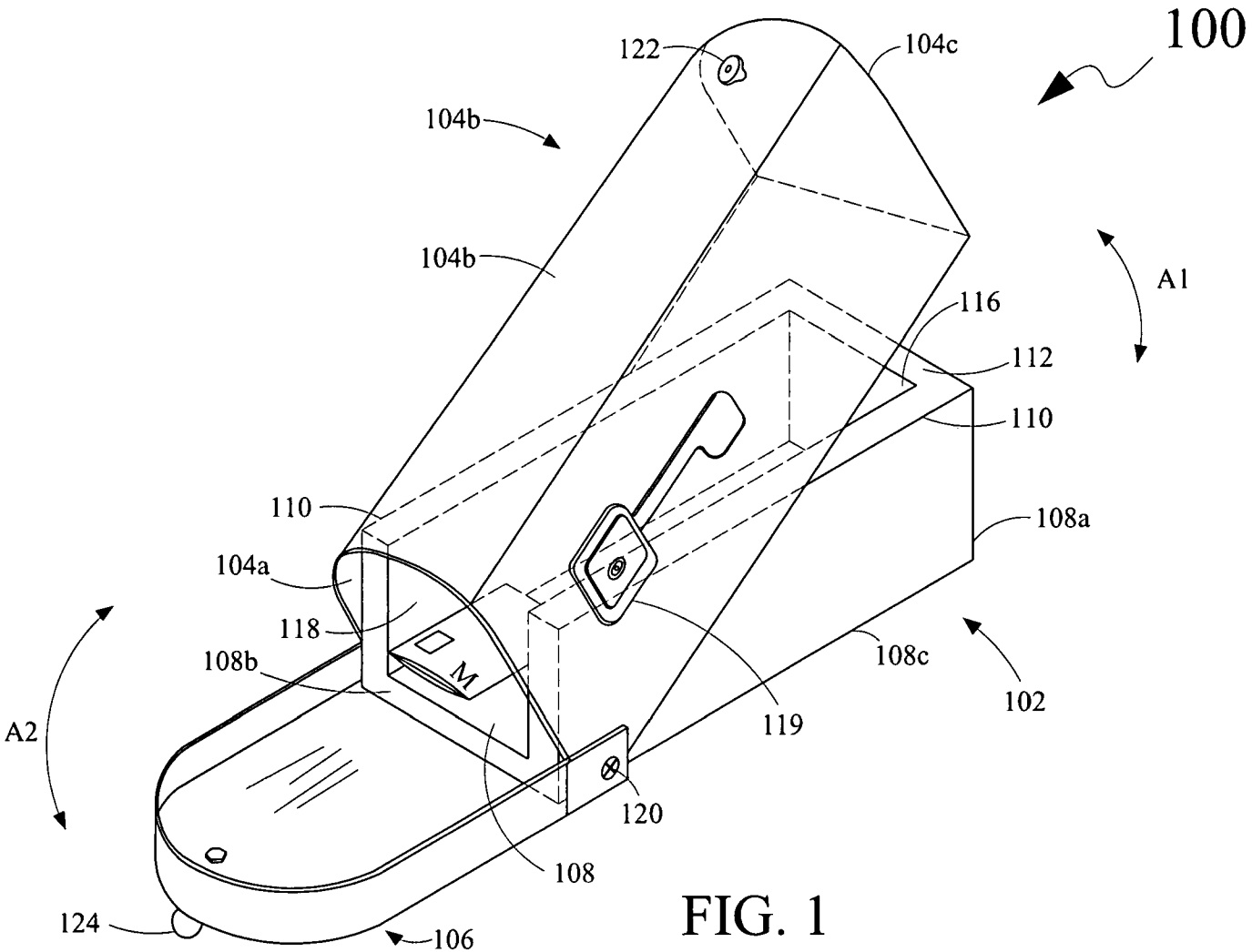
FIG. 1 illustrates a perspective view of a mailbox, in accordance with an exemplary embodiment of the present invention.

Referring to FIG. 1, the mailbox, such as a mailbox 100, is illustrated. FIG. 1 is a perspective view of the mailbox 100, in accordance with an exemplary embodiment of the present invention.

The mailbox 100 comprises a lower member 102, an upper member 104, and a front member 106. The lower member 102 comprises a base 108, a pair of lateral sidewalls 110 opposite to each other and a rear wall 112. The base 108 has a flat structure comprising a rear side portion 108*a*, a front side portion 108*b* and a pair of lateral side portions 108*c*. The pair of lateral sidewalls 110 extends upwardly from the pair of lateral sides portions 108*c*. Similarly, the rear wall 112 extends upwardly from the rear side 108*a* of the base 108. It will be apparent to a person skilled in the art that the base 108, the pair of lateral sidewalls 110 and the rear wall 112 configure a box shaped enclosure having a top opening 116 and a front opening 118. The top opening 116 and the front opening 118 of the lower member 102 facilitates the user to place mail (shown as symbol 'M') in the box shaped structure of the lower member 102 or retrieve the mail therefrom.

The upper member 104 is pivotally connected to the lateral sidewalls adjacent the front side portion 108*b* of the base 108 and is configured to at least partially enclose the base 108, the pair of lateral sidewalls 110 and the rear wall 112 of the lower member 102. In an embodiment of the present invention, the upper member 104 includes an arcuate upper portion 104*b*, a rear portion 104*c* and an opening 104*a*. The arcuate upper portion 104*b* of the upper member 104 has been preferably designed to give a conventional look to the mailbox 100. However, it will be obvious to a person skilled in the art to configure the arcuate upper portion 104*b* having shapes other than as shown in FIG. 1. The upper member 104 is pivotally coupled through a pivot pin 120 to the lateral sidewalls adjacent the front side portion 108*b* of the base 108, which is proximate to the front opening 118. Due to a movement of the upper member 104 about the pivot pin 120, the upper member 104 is capable of at least partially enclosing the pair of lateral sidewalls 110 and the rear wall 112, in such a manner that the opening 104*a* of the upper member 104 aligns with the front opening 118 of the lower member 102. The present invention further provides the mailbox 100 with a mailbox flag 119, which may be pivotally coupled to the upper member 104 for indicating a status of the mail, such as the presence of the mail in the mailbox 100.

The front member 106 is also pivotally coupled to the lateral sidewalls of the base 108 adjacent the front side portion 108*b*, which is proximate to the front opening 118. In one embodiment of the present invention, the front member 106 is coupled with the pivot pin 120, where the upper member 104 is also coupled. However, the front member 106 and the upper member 104 may be connected to different pivot pins similar to the pivot pin 120. In one embodiment of the present invention, the pivot pin 120 is configured to extend through the lateral sidewalls adjacent the front side 108*b* of the base 108, pivotally coupling the front member 106 and the upper member 104 to the base 108. However, it will be apparent to persons skilled in the art that there may be two pivot pins, each similar to the pivot pin 120, coupled to two distal ends of the front side 108*b* of the base 108, which may pivotally couple the front member 106 and the upper member 104 to the base 108 of the lower member 102. A pivotal coupling at the pivot pin 120, among the lower member 102, the upper member 104, and the front member 106, enables the upper member 104 and the front member 106 to rotate about the pivot pin 120.

The pivotal coupling by the pivot pin 120 enables the upper member 104 of the mailbox 100 to rotatably move between a lower position (not shown) and an upper position (not shown), which is shown by an arrow (A1). In the lower position, the upper member 102 closes the top opening 116, thereby closing the access to the mailbox 100 by the user from three sides, such as a rear side and two lateral sides of the mailbox 100. The upper position of the upper member 104 causes an opening of the top opening 116. In the upper position of the upper member 104, the user may place or retrieve the mail through the top opening 116 by standing at the rear side or either of the two lateral sides of the mailbox 100. A rotating movement of the upper member 104 is facilitated by a first knob 122, which is coupled to the upper member 104. The first knob 122 may be gripped by the user to rotatably move the upper member 104 between the lower position and the upper position of the upper member 104.

In a similar fashion, the pivotal coupling with the pivot pin 120 enables the front member 106 of the mailbox 100 to rotatably move between a vertical position and a horizontal position, as shown by an arrow (A2). The vertical position of the front member 106 closes the opening 104*a* of the upper member 104, thereby restricting the access of the mailbox 100 from a front side of the mailbox 100. In the vertical position of the front member 106, the opening 104*a* of the upper member 104 aligns to the front opening 118 of the lower member 102. Further, the horizontal position of the front member 106 exposes the opening 104*a* of the upper member 104, thereby providing the user an access to the mailbox 100 from the front side of the mailbox 100. A rotating movement of the front member 106 may be facilitated by a second knob 124 coupled to the front member 106. The second knob 124 may be gripped by the user to rotatably move the front member 106 between the vertical position and the horizontal position of the front member 106. It will be apparent to a person skilled in the art that the mailbox 100 provides a four way access to the user. More specifically, the user may place or retrieve the mail in the mailbox 100 by standing at the front side, the rear side and the two lateral sides of the mailbox 100.

Figure 2:
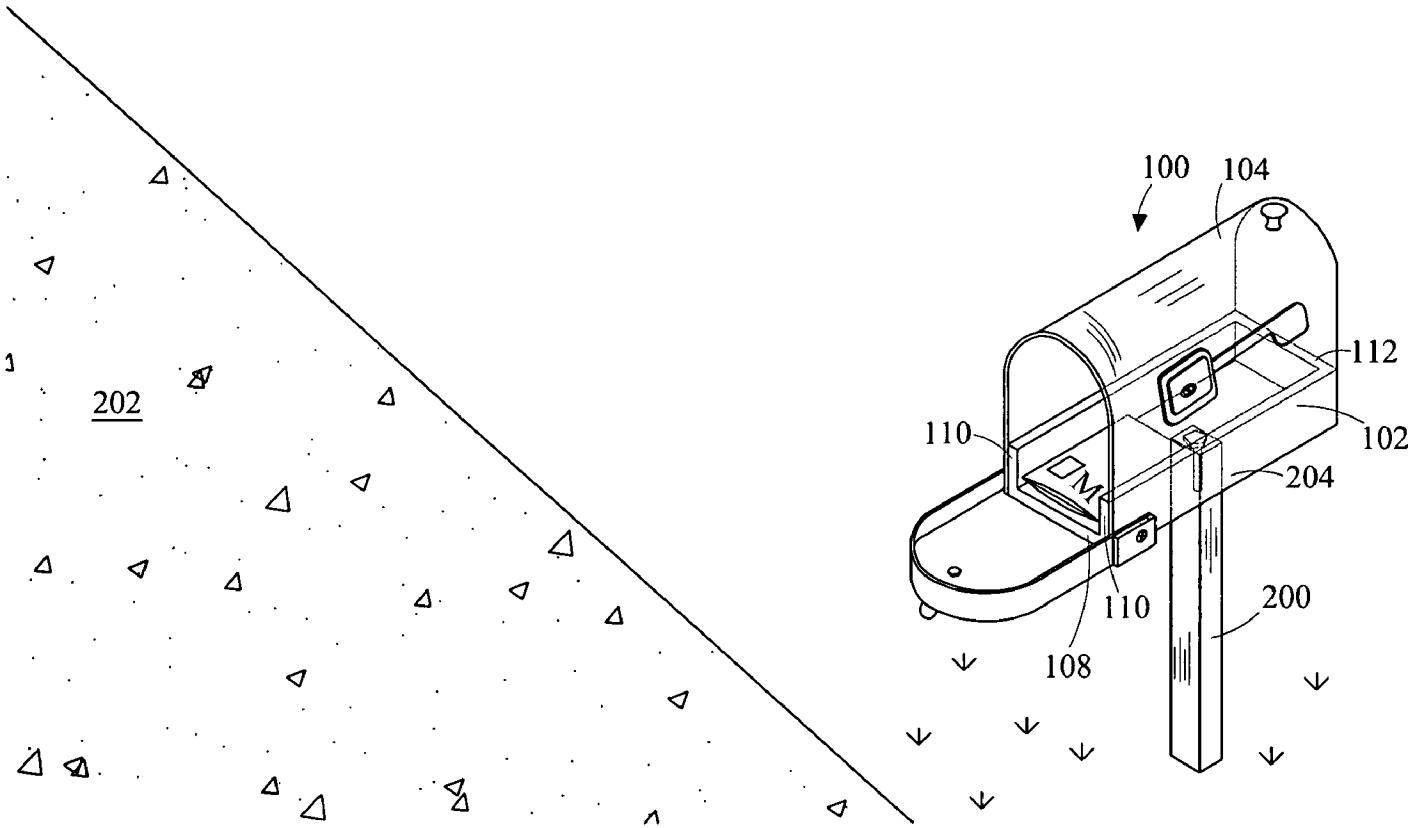
FIG. 2 illustrates a perspective view of the mailbox coupled to a post on a roadside, in accordance with an exemplary embodiment of the present invention.

Further, the mailbox 100 may be coupled to a post at a sufficient height such that the user may place or retrieve the mail in a standing position of the user. Referring now to FIG. 2, the mailbox 100 is shown, which is coupled to the post, such as a post 200, along a roadside 202. The mailbox 100 may be coupled to the post by using a suitable coupling mechanism, which couples the base 108 of the lower member 102 to the post 200. The examples of the coupling mechanism may be at least one of a screw, a nail and a nut-bolt. The coupling mechanism, such as a screw 204, which extends from the base 108 to the post 200, is shown in FIG. 2, thereby coupling the mailbox 100 to the post 200. It will be apparent to persons ordinary skilled in the art that screw 204 enables a mounting of the mailbox 100 at the post 200.

The present invention provides a comfortable fastening of the screw 204, which may be fastened by a fastener (not shown). Specifically, the lower member 102 provides enough space to use the fastener to fasten the screw 204 to couple the mailbox 100 to the post 200 due to appropriately chosen heights of the pair of sidewalls 110 and the rear wall 112. When the upper member 102 is rotatably moved to the upper position, the top opening 116 of the mailbox 100 is in an open position, which facilitates the user to place and retrieve the mail M from the mailbox 100. It will be apparent to persons ordinary skilled in the art that in the upper position of the upper member 104, the user may place and retrieve mail by standing at the rear side or any of the two lateral sides of the mailbox 100 without bending his/her body. This ensures safety of the body of the user from traffic running along the roadside 202. Further, when the front member 106 is in the horizontal position, the opening 104*a* may facilitate the user to place and retrieve the mail, while sitting in a vehicle (not shown), along the roadside 202.

The present invention provides a mailbox, such as the mailbox 100 as disclosed herein, is advantageous for the safety of a user while using the mailbox by a running traffic, when the mailbox 100 is positioned on a roadside. More specifically, the present invention ensures the safety of the user by not exposing the body of the user to the roadside while he/she is using the mailbox, since the user may use the mailbox by standing on others sides of the mailbox rather than standing at a front side of the mailbox, which is on the roadside. Further, the mailbox also has a front opening, which provides the user an option of using the mailbox from the front side of the mailbox. The use of the mailbox from the front side may be desirable by the user, when the user is sitting in a vehicle parked on the roadside. Furthermore, the positioning of the mailbox on a post at a sufficient height facilitates the user to use the mailbox without bending his/her body. Furthermore, the mailbox of the present invention does not require a mounting plate to couple the mailbox onto the post.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, to thereby enable others skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present invention.

What is claimed is:

1. A mailbox for placing and retrieving mail, the mailbox comprising:

a lower member comprising a base having a flat structure comprising a rear side portion, a front side portion and a pair of lateral side portions, a pair of lateral sidewalls opposite to each other extending upwardly from the pair of lateral sides portion of the base, and a rear wall extending upwardly from the rear side portion of the base, wherein the base, the pair of lateral sidewalls and the rear wall define a box shaped enclosure with a top opening and a front opening;

an upper member pivotally coupled to the lateral sidewalls adjacent the front side portion of the base by a pivot member, the upper member configured to at least partially enclose the pair of lateral sidewalls and the rear wall of the lower member to close the top opening of the lower member, the upper member comprising an opening, wherein the opening of the upper member is capable of being aligned with the front opening of the lower member; and a front member pivotally coupled to the lateral sidewalls adjacent the front side portion of the base by a pivot member, the front member configured to close the opening of the upper member thereby closing the front opening of the lower member.

2. The mailbox of claim 1, wherein the upper member further comprises a knob, wherein the knob is gripped to hold the upper member to facilitate the upper member to rotatably move between a lower position and an upper position, the lower position of the upper member closing the top opening, and the upper position of the upper member opening the top opening.

3. The mailbox of claim 1, wherein the front member comprises a knob, wherein the knob is gripped to hold the front member to facilitate the front member to rotatably move between a vertical position and a horizontal position, the vertical position of the front member closing the opening of the upper member and the horizontal position of the front member exposing the opening of the upper member.

4. The mailbox of claim 1, further comprising a coupling mechanism to couple the mailbox to a post, wherein the coupling mechanism is at least one of a screw, a nail and a nut-bolt.

5. The mailbox of claim 1, further comprising a mailbox flag pivotally mounted at the upper member for indicating a status of the mail.

6. The mailbox of claim 1, wherein the upper member comprises an arcuate upper portion and a rear portion, the arcuate upper portion configured to at least partially enclose the pair of lateral sidewalls of the lower member and the rear portion configured to at least partially enclose the rear wall of the lower member.

7. The mailbox of claim 1, further comprising the pivot member being a pivot pin disposed adjacent the front side portion of the base of the lower member to pivotally couple the upper member and the front member to the lower member.

* * * * *